US005856654A

United States Patent [19]

Frasnetti et al.

[11] Patent Number: 5,856,654

[45] Date of Patent: Jan. 5, 1999

[54] TEMPERATURE CONTROL AND SAFETY DEVICE ASSOCIATED WITH A HEATING ELEMENT OF A GLASS CERAMIC COOKING HOB, ARRANGED TO PREVENT OVERHEATING THEREOF

[75] Inventors: Luca Frasnetti, Cunardo; Davide Cabri, Morazzone; Guido Gagliardi, Busto Arsizio; Daniele Valassina, Gemonio, all of Italy

[73] Assignee: Whirlpool Corporation, Benton Harbor, Mich.

[21] Appl. No.: 957,152

[22] Filed: Oct. 24, 1997

[51] Int. Cl.[6] ..... H05B 1/02

[52] U.S. Cl. ..... 219/481; 219/449; 219/510; 219/458; 219/494

[58] Field of Search ..... 219/481, 483, 219/485, 494, 448, 449, 510, 453, 458, 497; 338/22 R

[56] References Cited

U.S. PATENT DOCUMENTS

| | | | |
|---|---|---|---|
| 2,988,625 | 6/1961 | Hart | 219/449 |
| 4,577,176 | 3/1986 | Bayer | 337/394 |
| 4,901,049 | 2/1990 | Kircher et al. | 219/449 |
| 5,055,819 | 10/1991 | Goessler et al. | 337/394 |
| 5,310,993 | 5/1994 | McWilliams | 219/449 |
| 5,430,427 | 7/1995 | Newman et al. | 338/22 R |
| 5,489,764 | 2/1996 | Mannuss et al. | 219/464 |

*Primary Examiner*—Mark H. Paschall

*Attorney, Agent, or Firm*—Robert O. Rice; Andrea R. Powers; Joel M. Van Winkle

[57] ABSTRACT

A safety device associated with a heating element of a glass ceramic cooking hob and arranged to prevent overheating of the cooking hob, the element comprising an insulating body defining a seat containing at least one heat generator, the device comprising a measuring member arranged to measure the temperature of the heating element and to deactivate the operation of the heat generator whenever this temperature exceeds a predetermined value, the measuring member being associated externally with a side wall of the insulating body and having a measuring part connected to a body passing through said wall and projecting to a limited extent above the heat generator.

10 Claims, 1 Drawing Sheet

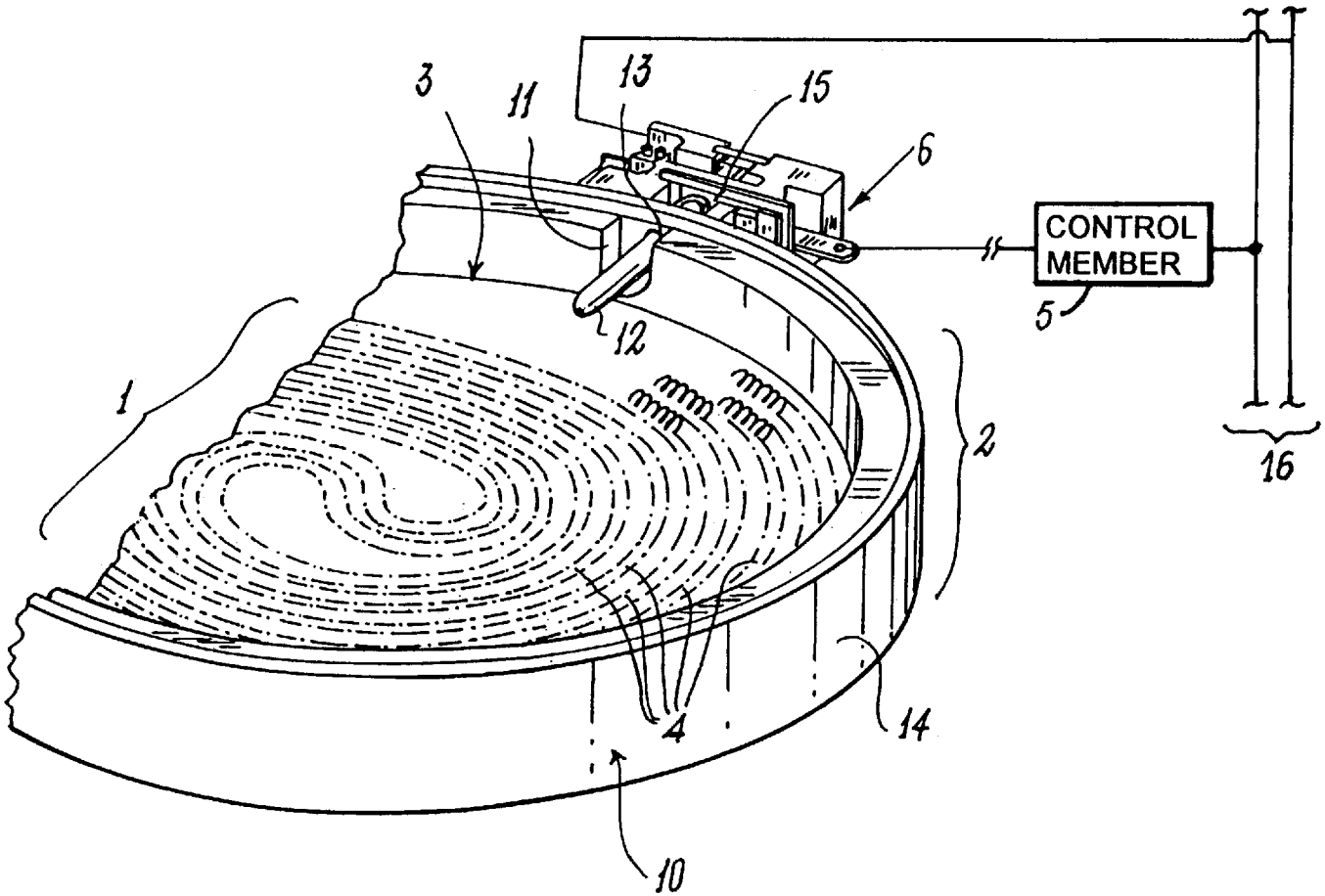
CONTROL MEMBER
5
16
6
15
13
11
3
12
2
14
4
10
1

TEMPERATURE CONTROL AND SAFETY DEVICE ASSOCIATED WITH A HEATING ELEMENT OF A GLASS CERAMIC COOKING HOB, ARRANGED TO PREVENT OVERHEATING THEREOF

BACKGROUND OF THE INVENTION

1. Field of the Invention

This invention relates to a device in accordance with the introduction to the main claim.

2. Description of the Related Art

A glass ceramic cooking hob is known to comprise a plurality of heating elements positioned below the glass ceramic surface. Each heating element comprises an insulating body defining a seat to contain one or more heat generators (electrical resistance elements, halogen lamps or the like) the operating temperature of which must be continuously controlled both in order to correspond to that chosen by the user, and for safety reasons (for example to prevent overheating of and damage to the glass ceramic hob). Associated with each heating element there are therefore provided temperature measurement means connected to means for controlling the electrical supply to the heat generators which, on the basis of the user's choice and the signals originating from said measurement means, control the activation of said heat generators.

Several temperature control and safety devices associated with the aforesaid heating elements are known. One of these comprises an electromechanical component which varies the positive duty cycle of each heat generator associated with it in order to control the temperature (and hence the heat transmitted to a saucepan standing on it). With such a device, maximum heating level is obtained by connecting the heat generator directly to the electric mains (by way of said control device). Under these conditions a safety member is required for preventing overheating of that part of the glass ceramic hob positioned above the heating element. This member is generally a controlling thermostat, which is however a relatively costly component (negatively affecting the cost of the cooking hob to the public) and very fragile, hence requiring delicate handling.

Moreover, the combination of a thermostat with the said electromechanical control component does not offer performance reliability, i.e. does not ensure constant performance of a cooking hob of the examined type repeatable with time.

SUMMARY OF THE INVENTION

An object of the present invention is to provide an improved temperature control and safety device for a heating element of a glass ceramic cooking hob.

A particular object of the invention is to provide a device of the said type which is of very low cost compared with known devices and is easier to transport and handle than the other known devices.

These and further objects which will be apparent to the expert of the art are attained by a device in accordance with the accompanying claims.

BRIEF DESCRIPTION OF THE DRAWINGS

The present invention will be more apparent from the accompanying drawing, which is provided by way of non-limiting example and in which the single figure represents a partial perspective view of a heating element with which the device of the invention is associated.

DESCRIPTION OF THE PREFERRED EMBODIMENT

Said figure shows a usual heating element 1 comprising an insulating body 2 defining a seat 3 containing a plurality of heating elements or generators 4, for example electrical resistance elements, powered in known manner. The operation of these elements is controlled by a control member 5 which is connected to a temperature-sensitive measuring member 6 operating as a temperature limiter and arranged to prevent said powering if the temperature of the heating element exceeds that chosen by the user, for example because of a fault in said member 5.

More specifically, the body 2 comprises an annular wall 10 of insulating material. Within the wall 10 there is provided a recess 11 through which there passes an elongate part 12 of heat-sensitive material (metal). This part, which acts simply as a member for transmitting the heat to the exterior of the heating element 1 (and is without any temperature measuring member) passes through a hole 13 provided in a further portion 14 of said wall 10 and is associated with a heat-sensitive surface or measuring part 15 of the member 6. The temperature-sensitive member 6 is directly connected to the electric mains 16 to which the control member 5 is connected, and by which the heating element is powered.

The member 6 acts as a thermal switch providing temperature protection (safety member), as stated. Up to the present time such a member has never been used as a limiter in glass ceramic cooking hobs because its particular configuration (with a flat sensitive surface) enabled it to measure only the outer surface of the heating element with which it was associated (i.e. of the wall 10). Because of the presence of the insulating material in the wall 10, the temperature of this surface was never representative of the actual temperature generated by the heat generators, hence the intervention of this limiter was more influenced by the conditions external to the heating element than the internal conditions thereof.

By virtue of the invention, these problems have now been overcome by associating the elongate part 12 with the sensitive surface 15 of the limiter member 6 and prolonging this part to a limited extent into the seat 3 of the heat generators 4. By way of example, the part 12 has a relatively small diameter relative to the dimensions of the heating element but sufficient to overlie it by that minimum extent enabling the heat generated by the heating element to be transferred to the safety member 6. The dimensions, the material and the form of the part 12 are chosen to achieve on the sensitive surface 15 of the member 6 a temperature which is reliably proportional to the temperature of the heat generators 4 (i.e. the temperature present within the heating element 1) for the purpose of setting the necessary safety interventions.

By virtue of the invention, a temperature limiting member is obtained which operates by cutting off power to the heat generators when the temperature exceeds a predetermined value, and moreover is simple, is of easy handling and is of much lower cost than analogous known limiting members.

Such a member can be used in connection with an electromechanical control member or better still with a control member operating in accordance with a predetermined and pre-programmed procedure for powering the heating element 1 which is able to estimate the temperature of the glass ceramic hob above said element 1. By way of example, this member can be a microprocessor unit operating in accordance with fuzzy logic. By virtue of this unit (or similar units) various modes of operation of the heating element can be obtained, such as a mode of operation in which it is maintained at an average temperature set by the user, so as to maintain the food on the cooking hob (contained in corresponding containers) at an average temperature, or a mode of operation in which activation cycles of the heating element are followed by deactivation cycles, such as to maintain a constant average temperature, for energy saving purposes.

One embodiment of the invention has been described. Others can however be deduced from the aforegoing description, and hence are to be considered as failing within the scope of the present document.

We claim:

1. A safety device associated with a heating element of a glass ceramic cooking hob and arranged to prevent overheating of the cooking hob, said element comprising an insulating body defining a seat containing at least one heat generator, said device comprising a measuring member sensitive to the temperature of said heating element and arranged to deactivate the operation of the heat generator whenever such temperature exceeds a predetermined value, wherein said measuring member is external to a side wall of the insulating body and has a measuring part responsive to internal temperature connected to a heat transmitting elongate part passing through said wall and projecting partially above the heat generator, said body becoming heated following the generation of heat by said generator, said heat being transferred to the measuring part external to the heating element so as to be measured by said measuring part, and so enable the measuring member to act on the power supply to said generator, in order to interrupt said power whenever such temperature exceeds the predetermined value.

2. A device as claimed in claim 1, wherein the measuring member is a thermal safety switch.

3. A device as claimed in claim 2, wherein the elongate part projecting above the heat generator is a heat transmitting member.

4. A device as claimed in claim 3, wherein the projecting elongate part passes through a hole provided in the wall of the insulating body and projects to a limited extent above the heat generator.

5. A device as claimed in claim 1, wherein the measuring member external to the heating element is connected to means for controlling the operation of said element.

6. A device as claimed in claim 5, wherein the control means are a control member operating in accordance with a predetermined and pre-programmed procedure for powering the heating element which is able to estimate the temperature of the glass ceramic hob part above said element.

7. A device as claimed in claim 6, wherein the control member is a microprocessor unit operating in accordance with fizzy logic.

8. A device as claimed in claim 1, wherein the elongate part projecting above the heat generator is a heat transmitting member.

9. A device as claimed in claim 2, wherein the projecting elongate part passes through a hole provided in the wall of the insulating body and projects to a limited extent above the heat generator.

10. A device as claimed in claim 1, wherein the projecting elongate part passes through a hole provided in the wall of the insulating body and projects to a limited extent above the heat generator.

* * * * *